United States Patent [19]

Specker et al.

[11] Patent Number: 4,950,539

[45] Date of Patent: Aug. 21, 1990

[54] PRODUCT AND METHOD OF PRODUCING A SMOOTH POLYESTER YARN

[75] Inventors: Hugo Specker, Sempach Stadt; Paul Schaffner, Kriens, both of Switzerland

[73] Assignee: Viscosuisse SA, Emmenbrücke, Switzerland

[21] Appl. No.: 219,067

[22] PCT Filed: Oct. 20, 1987

[86] PCT No.: PCT/CH87/00143

§ 371 Date: Jun. 9, 1988

§ 102(e) Date: Jun. 9, 1988

[87] PCT Pub. No.: WO88/03185

PCT Pub. Date: May 5, 1988

[30] Foreign Application Priority Data

Oct. 24, 1986 [CH] Switzerland ..... 4239/86

[51] Int. Cl.[5] ..... D02J 1/22; D01D 5/12

[52] U.S. Cl. ..... 428/364; 264/210.8; 264/289.6; 264/290.5

[58] Field of Search ..... 264/290.5, 290.7, 210.8, 264/289.6; 428/364

[56] References Cited

U.S. PATENT DOCUMENTS

| | | | |
|---|---|---|---|
| 3,651,198 | 3/1972 | Mitsuishi et al. | 264/290.5 |
| 3,770,866 | 11/1973 | Sakata et al. | 264/289.6 |
| 3,816,486 | 6/1974 | Vail | 264/289.6 |
| 4,195,052 | 3/1980 | Davis et al. | 264/210.8 |

FOREIGN PATENT DOCUMENTS

| | | | |
|---|---|---|---|
| 80906 | 6/1983 | European Pat. Off. | 264/210.8 |
| 203165 | 11/1983 | Japan | 264/289.6 |
| 116414 | 7/1984 | Japan | 264/210.8 |
| 991642 | 5/1965 | United Kingdom | 264/210.8 |

OTHER PUBLICATIONS

Lieferprogramm, Viscosuisse, Switzerland, (no translation).

Industrial Aspects of High Speed Spinning, Kawaguchi, Historical Review.

Textilveredlung, Die wichtigsten Chemiefasern, Erweiterter Sonderdruck, 1972, (no translation).

*Primary Examiner*—James Lowe

*Attorney, Agent, or Firm*—Michael J. Striker

[57] ABSTRACT

A method of producing a smooth, cold-drawn multifilament yarn from a polyester POY comprising cold-drawing of the polyester POY to a draw ratio of at least 1.6 and subsequent hot-relaxing the polyester POY under an over-feed of 10 to 20%, and a polyester yarn produced by this method.

5 Claims, 4 Drawing Sheets

PRODUCT AND METHOD OF PRODUCING A SMOOTH POLYESTER YARN

BACKGROUND OF THE INVENTION

The present invention relates to a method of producing a smooth, cold-drawn, multifilament yarn from polyester POY (partially oriented yarn) and to a yarn produced by this process.

A smooth multifilament yarn is to be understood as meaning an untextured multifilament yarn which retains its uncrimped flat shape even on boiling in water.

Polyester is to be understood as meaning a thermoplastic material prepared from at least 85% by weight of terephthalic acid and ethylene glycol.

Polyester POY refers to a polyester yarn which has a linear density of about 50 to 1,200 dtex and was melt-spun at a speed of about 2,800 to 4,000 m/min.

In the present invention, cold drawing refers to drawing at yarn temperatures which are significantly below the glass transition temperature of the polyester, i.e. appreciably below 85° C. For example, a delivery roller for the drawing can be unheated or be at a temperature of up to 70° C. The drawing can take place with or without the use of a drawing peg.

Homogeneous cold drawing is to be understood as meaning that the draw ratio has to be chosen sufficiently high to ensure that, in the drawn yarn, there are no undrawn areas or areas drawn to less than the draw ratio, which is discernable for example in the Uster %, which in general should be $<1.5$. For POY from the stated speed range, this means that the draw ratio shall be at least 1.6, depending on a spin speed.

For the purposes of the present invention, hot relaxation is a treatment which causes a decrease in the length of the yarn by heat treatment at temperatures above the glass transition temperature. The extent of the decrease in length is determined by the overfeed VE:

$$\% VE = \frac{V_L - V_A}{V_A} \cdot 100$$

$V_L$=speed of delivery system $V_A$=speed of take-off system

The production of a cold-drawn polyester yarn from POY spun at more than 4,000 m/min is known from (JP-A-53-143,728).

DE-A-2,839,672 discloses a polyester replacement yarn for cellulose acetate, having a boil shrinkage of 2 to 6% and obtainable by direct high-speed spinning at about 4,000 m/min without the use of a drawing system or any heat treatment. In this publication, a boil shrinkage of less than 2% is referred to as extremely low and as very difficult to obtain directly.

The main disadvantage of the known yarn consists in that its shrinkage is still too high. In addition, such a yarn has to be shrunk before package dyeing and be rewound onto perforated dyeing centers.

SUMMARY OF THE INVENTION

It is an object of the present invention to provide a process whereby it is possible to prepare a yarn which has an extremely low shrinkage while resembling a cellulose acetate or viscose yarn in-its other properties.

This object is achieved according to the invention by a method of producing a polyester yarn which is characterized in that the polyester POY, in a first process step, is homogeneously cold-drawn to a draw ratio of at least 1.6 and, in a second process step, is hot-relaxed under an overfeed of 10 to 20%.

In the range from 10 to 20% overfeed, preferably from 12 to 18% overfeed, with simultaneous heat treatment, the product is surprisingly a virtually shrinkage-free yarn which produces a full-bodied, soft sheetlike structure which has good drape and a silky lustre in the case of undelustred polymer.

The resulting yarn is highly suitable for use as a replacement material for cellulose acetate in smooth sheetlike structures and exhibits high utility for napping.

If the overfeed is less than 10%, the result is a yarn having an excessively high shrinkage; an overfeed of more than about 20% gives rise to a form of crimping which is undesirable for the intered use as a smooth yarn.

It is expedient to carry out the dry heat treatment at 140° to 250° C., preferably at 200° to 230° C., in particular at 225° C., combined with a heater length of at least 200 mm.

However, it is also possible to carry out the heat treatment in a fluid, advantageously in water/steam, at 70° to 140° C.

It is expedient to carry out the relaxation at a take-off speed of 100 to 1,000 m/min, preferably at 300 to 700 m/min.

The yarn produced by the process according to the invention is characterized by its stress-strain diagram. Reproducing the complete stress-strain diagram is very revealing of the mechanicaL properties of the yarn under test. In addition, the parameters initial modulus, reversibility limit, tensile strength and elongation at break are determined therefrom in a conventional manner, for example the initial modulus on the linear slope at the start of the diagram, while the reversibility limit corresponds to that strength at which the diagram deviates from the linear curve.

Customarily, yarns of this type are also described by means of a number of thermomechanical parameters which refer to the later processing conditions or performance characteristics. These are the shrinkages (=length changes) or shrinkage forces resulting at defined temperatures and pretensioning forces in water or hot air (see explanations with table).

The yarn according to the invention shall in detail meet the following conditions at one and the same time. It shall have an initial modulus of 200 to 800 cN/tex, in particular 350 to 500 cN/tex, a reversibility limit of 4 to 12 cN/tex, in particular 6 to 12 cN/tex, a boil shrinkage of 0 to 2.8%, in particular 0 to 2%, and intrinsic viscosity of 0.60 to 0.75 dl/g, in particular 0.62 to 0.66 dl/g, measured at 25° C. in a 1:1 mixture of phenol/ tetrachloroethane, a thermoshrinkage of $<2\%$ at 160° C. and a pretensioning force of 0.1 cN/tex, and a shrinkage force, measured under the same temperature and pretensioning force conditions, of 0.1 cN/tex.

The substantially relaxed yarn has the advantage that, in the event of a package dyeing, it can be twisted directly without steaming or rewinding onto a perforated dyeing center.

The invention will be illustrated in more detail by reference to examples.

The starting material in both examples is a polyester POY having an intrinsic viscosity of 0.62 dl/g.

Example 1 (continuous process)

A 100-dtex 36-filament polyester POY, produced at a spin speed of 3,100 m/min, is cold-drawn in the 1st stage on a two-stage draw-twist machine at room temperature in a ratio of 1:1.8 without drawing peg and then, in the 2nd stage, is guided under 10% overfeed over a plate-type heater having a length of 48 cm and a heater temperature of 225° C. The tensile force exerted on the yarn during processing in the 2nd stage results from the process-induced stress of relaxation. This is immediately followed by the intermingling at about 25 knots/meter and winding up at 420 m/min.

Example 2 (batch process)

A 100-dtex 36-filament polyester POY spun at 3,100 m/min is drawn at room temperature with a take-off speed of 530 m/min and a draw ratio of 1:1.8 without drawing peg and immediately intermingled after the drawing zone at about 15 knots/meter. In a second operation, the yarn is fed under a 20% overfeed through a closed radiator heater having a length of 70 cm and a heater temperature of 225° C. In this case too the tensile force exerted on the yarn during processing corresponds to the process-induced stress of relaxation. The take-off speed is 110 m/min.

The polyester yarns according to the invention are represented by their characteristic curves in FIGS. 2–4. In these figures, the curves obtained from the continuous and the batchwise process of manufacture are virtually identical.

DESCRIPTION OF THE DRAWINGS

The invention will be best understood from the following description with reference to appended drawings wherein.

DESCRIPTION OF THE PREFERRED EMBODIMENTS

Figure 1:
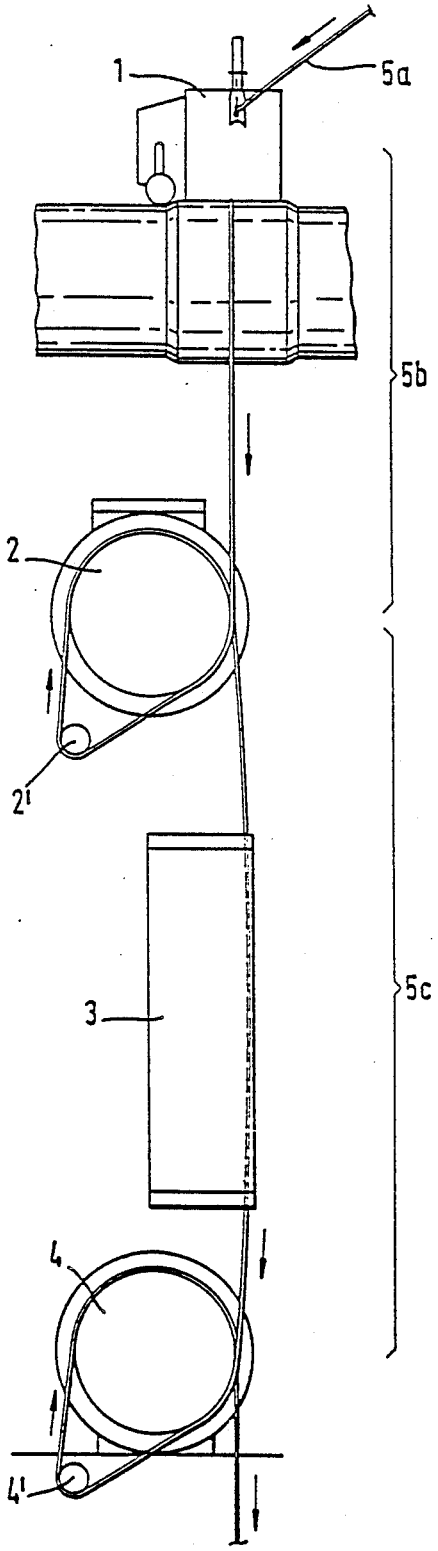
FIG. 1 shows a schematic block-diagram of the process according to the invention.

In FIG. 1, the reference numeral 1 designates a first delivery system 1. Delivery system 1 is followed by a second delivery system 2 with a separating roller 2'. A heater 3 is arranged between the delivery system 2 and a take-off system 4 with a separating roller 4' which is followed by a winding unit. An undrawn polyester POY 5a is taken up by the delivery system 1 and is cold-drawn by delivery system 2 in a drawing zone 5*b*. The take-off system 4 runs at a lower speed than the delivery system 2, as a result of which the drawn yarn passes under an adjustable overfeed preferably heater 3 in a relaxation zone 5*c*. The result is a hot-relaxed yarn having the properties according to the invention.

Figure 2:
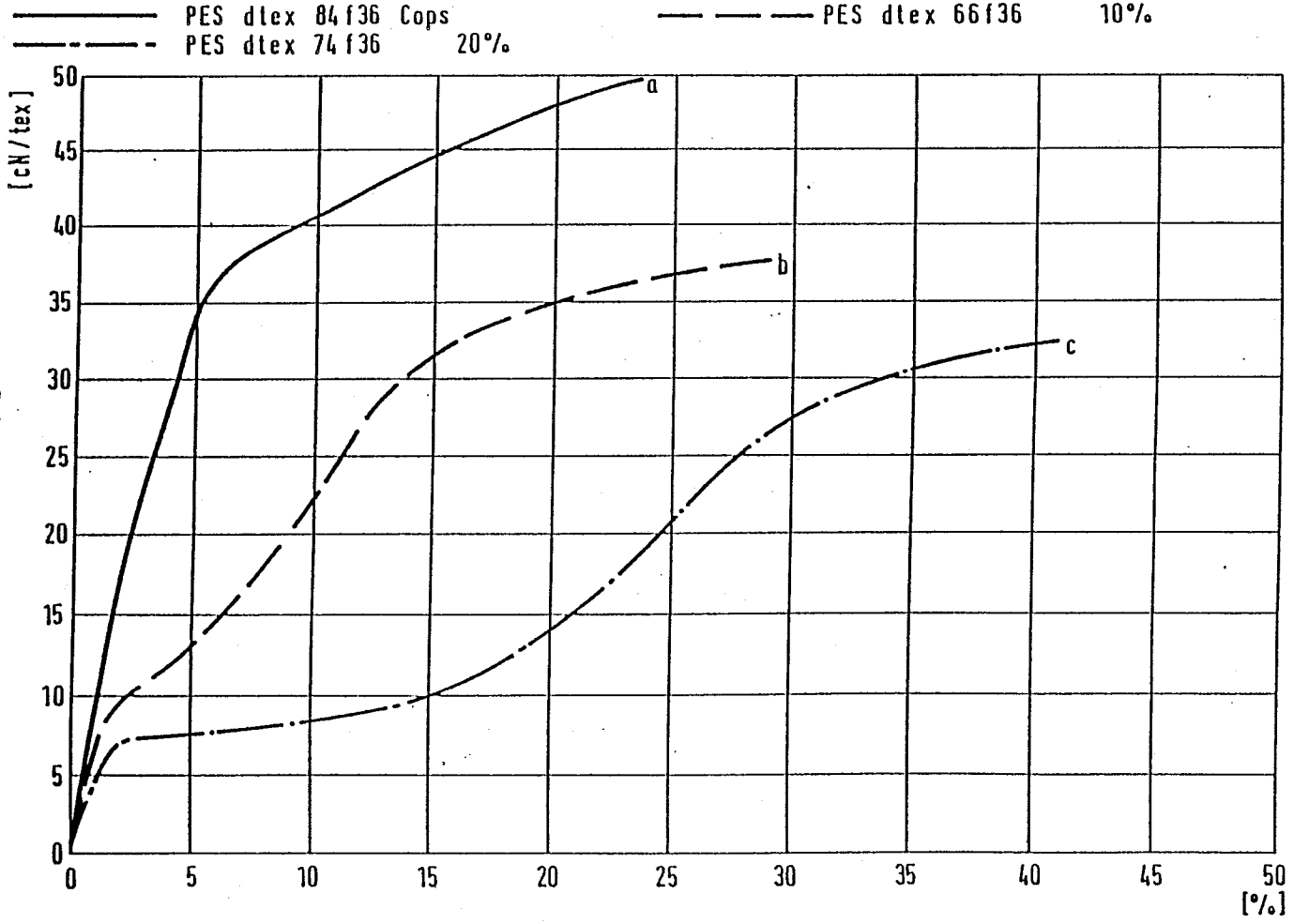
FIG. 2 shows stress-strain curves of polyester yarns according to the present invention.

It is easy to see the marked relaxation-induced shoulders in the curves of the yarns according to the invention in FIG. 2 show stress-strain curves representing dependence of stretching on the tensile strength of a yarn. The first curve "a" represents a stress-strain curve of an unshrunk polyester (PES) yarn which consists of thirty-six (36) single fibrels (f) wound on a yarn carrier cop and which has a total denier of 84 dtex, where dtex is an international measurement unit characterizing a fineness or denier of a yarn. For convenience, such a yarn is designed as a PES dtex 84 f 36 which is an internationally accepted abbreviation.

The second curve "b" represents a stress-strain curve of a PES dtex 66 f 36 relaxed yarn with a 10% overfeed, and a curve "c" represents a stress-strain curve of a PES dtex 74 f 36 relaxed yarn with a 20% overfeed. Generally, all polyester yarn produced according to the present invention would have stress strain curves lying in the region between curves "b" and "c".

Figure 3:
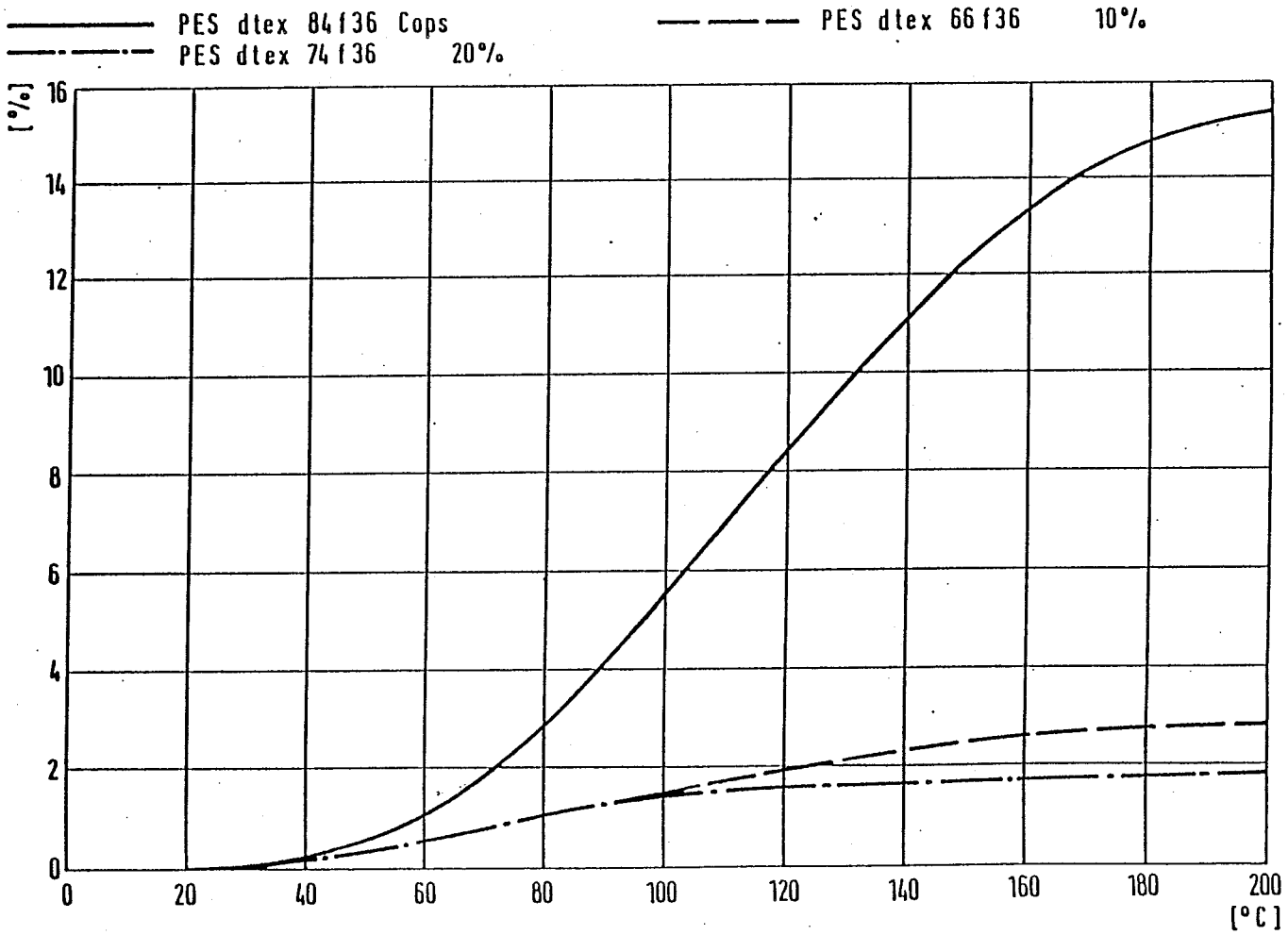
FIG. 3 shows thermoshrinkage curves of unloaded polyester yarns according the the present invention.

FIG. 3 shows thermoshrinkage values over the entire temperature range of the same polyester yarns shown in FIG. 2. As it is clearly shown in FIG. 3, the shrunk yarns have a much lower value than the unshrunk yarn.

Figure 4:
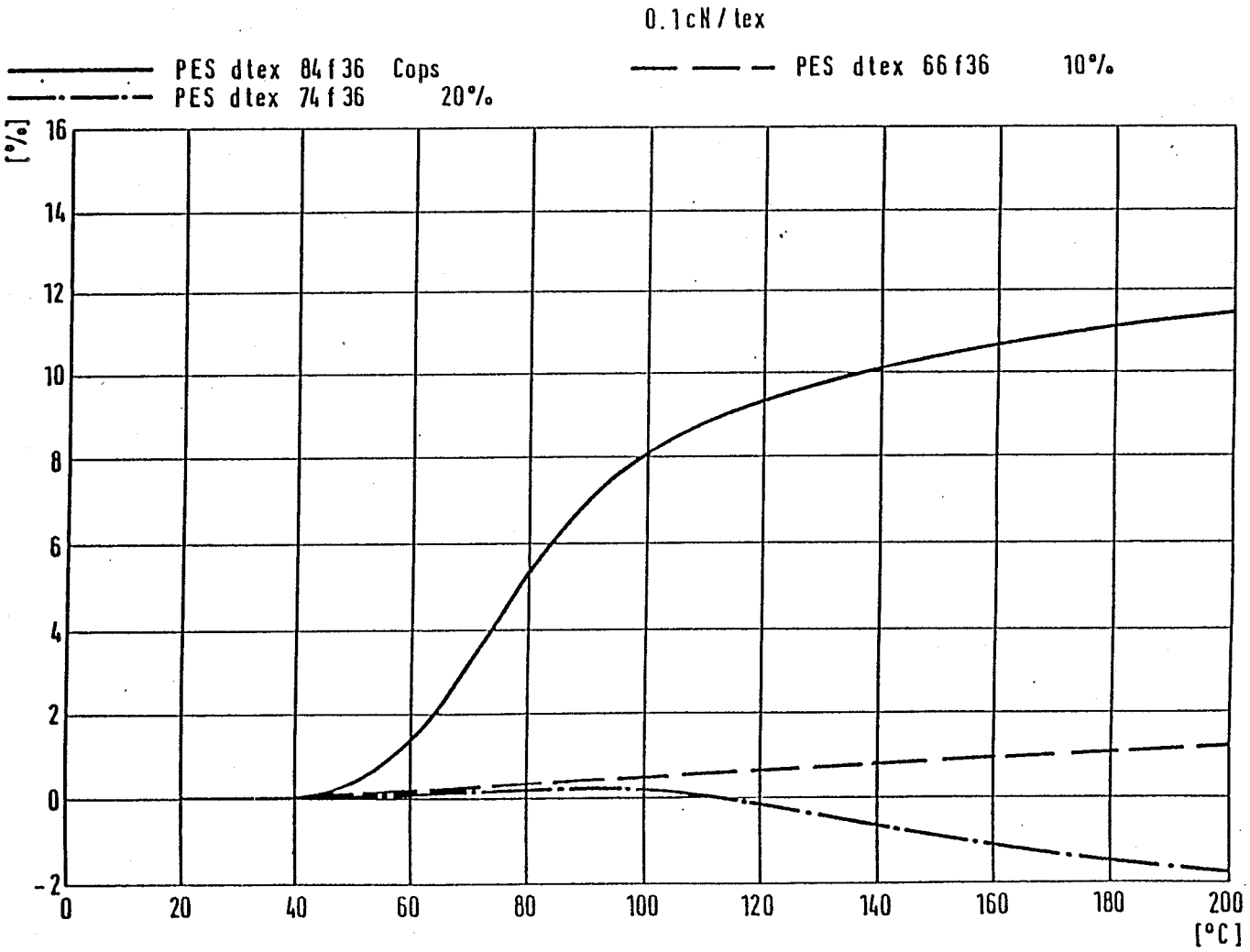
FIG. 4 shows thermoshrinkage curves of polyester yarns according to the present invention under a load of 0.1 cN/tex.

In addition, FIG. 4 shows the pronounced effect of the pretensioning force on the shrinkage with respect to the same yarns as in FIGS. 2 and 3.

For convenience, the results are summarized in the following table:

| | | Standard yarn on cops | Example A 10% VE | Example B 20% VE |
|---|---|---|---|---|
| Intrinsic viscosity | dl/g | 0.62 | 0.62 | 0.62 |
| Linear density | dtex | 71.7 | 65.6 | 74.4 |
| Strength | cN/tex | 41.0 | 37.5 | 32.0 |
| Elongation at break | % | 21.0 | 29.0 | 41.0 |
| Reversibility limit based on linear density | cN/tex | 18.0 | 8.4 | 6.0 |
| Initial modulus[4] based on linear density | cN/tex | 900 | 650 | 330 |
| Boil shrinkage[1] | % | 10.3 | 1.9 | 1.2 |
| Thermoshrinkage[1] permanent | % | 12.8 | 2.5 | 1.0 |
| Shrinkage[2] effective | % | 10.7 | 1.0 | 1.1* |
| Shrinkage force[3] based on linear density | cN/tex | 3.2 | 0.6 | 0.01** |
| Thermoshrinkage[5] modulus | cN/tex | 30.0 | 25.0 | 1.0 |
| Yarn non-uniformity | Uster % | 0.9 | 0.9 | 1.2 |
| Birefringence | $\Delta n \cdot 10^{-3}$ | 180.0 | 145.0 | 123.0 |

[1]Permanent change in length after shrinkage process carried out without tension (in hot air about 160° C., 15 min. or in hot water at 98° C., 15 min.)

[2]Change in length of yarn under a load of 0.1 cN/tex when heated (160° C., 15 min.)

[3]Specific change in force of yarn under a load of 0.1 cN/tex when heated (160° C., 15 min.)

[4]Specific force for 100% theoretical extension

[5]The effective shrinkage modulus ($Sm_e$) takes into account the three components linear density (T), effective shrinkage (Se) and the effective shrinkage force $Sk_e$ and is calculated as follows:

$$Sm_e[vN/tex] = \frac{\frac{Sk_e[cN] \cdot 10}{T[dtex]} \cdot 100}{Se[\%]}$$

*Yarn becomes longer

**Relative to the pretensioning force, the action of heat brings about a force reduction The yarn according to the invention is suitable for woven material, knitted material and in particular for pile material such as velvet, velour and the like. The improved tactile properties are very similar to those of cellulose acetate and viscose.

We claim:

1. A method of producing a smooth, cold-drawn multifilament yarn from a polyester POY comprising the steps of homogeneously cold-drawing the polyester POY to a draw ratio of at least 1.6; and subsequently hot-relaxing the polyester POY under an overfeed of 10 to 20%.

2. A method according to claim 1, wherein the hot-relaxing step includes hot relaxation at 140° to 250° C. in a dry medium.

3. A method according to claim 1, wherein the hot-relaxing step includes hot relaxating with a take-off speed of 100 to 1,000 m/min.

4. A smooth, cold drawn, multifilament yarn comprising a polyester POY produced by homogeneous cold-drawing to a draw ratio of at least 1.6 and subsequent hot-relaxing under an overfeed of 10 to 20%, and having the following characteristics at one and the same time:

| | |
|---|---|
| Initial modulus | 200–800 cN/tex |
| Reversibility limit | 4 to 12 cN/tex |
| Boil shrinkage less than | 3% |
| Intrinsic viscosity | 0.60–0.75 dl/g |

-continued

| | |
|---|---|
| Thermoshrinkage less than (at 160° C., 0.1 cN/tex pretension force) | 2% |
| Shrinkage modulus | 0–30 cN/tex |
| Uster less than | 1.5% |

5. A smooth cold-drawn multifilament yarn according to claim 4 wherein said yarn has a stress-strain curve lying in a region an upper limit of which is defined by a stress-strain curve of a PES dtex 66 f 36 yarn having a 10% overfeed and a lower limit of which is defined by a stress-strain curve of a PES dtex 74 f 36 yarn having a 20% overfeed.

* * * * *